US008910597B2

(12) United States Patent
Pattakos et al.

(10) Patent No.: US 8,910,597 B2
(45) Date of Patent: Dec. 16, 2014

(54) RECIPROCATING PISTON ENGINE

(76) Inventors: Manousos Pattakos, Nikea Piraeus (GR); Efthimios Pattakos, Nikea Piraeus (GR); Paraskevi Pattakou, Nikea Piraeus (GR); Emmanouel Pattakos, Nikea Piraeus (GR)

( * ) Notice: Subject to any disclaimer, the term of this patent is extended or adjusted under 35 U.S.C. 154(b) by 0 days.

(21) Appl. No.: 13/816,230

(22) PCT Filed: Aug. 10, 2011

(86) PCT No.: PCT/IB2011/053569

§ 371 (c)(1),
(2), (4) Date: Feb. 9, 2013

(87) PCT Pub. No.: WO2012/020384

PCT Pub. Date: Feb. 16, 2012

(65) Prior Publication Data

US 2013/0133627 A1 May 30, 2013

(51) Int. Cl.

| | |
|---|---|
| ***F02B 25/08*** | (2006.01) |
| ***F02B 75/28*** | (2006.01) |
| ***F01B 7/08*** | (2006.01) |
| ***F02B 75/32*** | (2006.01) |

(52) U.S. Cl.

CPC . *F02B 75/28* (2013.01); *F01B 7/08* (2013.01); *F02B 25/08* (2013.01); *F02B 75/282* (2013.01); *F02B 75/32* (2013.01)

USPC ..... 123/51 R; 123/51 BA; 123/51 B; 123/51 A; 123/61 R; 123/63

(58) Field of Classification Search

CPC ..... F02B 75/282; F02B 25/08; F02B 75/32; F02B 75/24–75/246; F02B 75/28; F01N 9/02; F01B 7/16; F01B 7/08

USPC ..... 123/51 BA, 61 R–63

See application file for complete search history.

(56) References Cited

U.S. PATENT DOCUMENTS

| | | | | |
|---|---|---|---|---|
| 1,629,878 | A * | 5/1927 | Mader | 123/51 R |
| 2,103,103 | A * | 12/1937 | Waters | 123/51 R |
| 2009/0165744 | A1 * | 7/2009 | Pattakos et al. | 123/197.3 |

* cited by examiner

*Primary Examiner* — Lindsay Low
*Assistant Examiner* — Kevin Lathers

(57) ABSTRACT

A single-crankshaft single-cylinder fully-balanced opposed piston engine module that provides extra time for the injection and the combustion of the fuel.

11 Claims, 17 Drawing Sheets

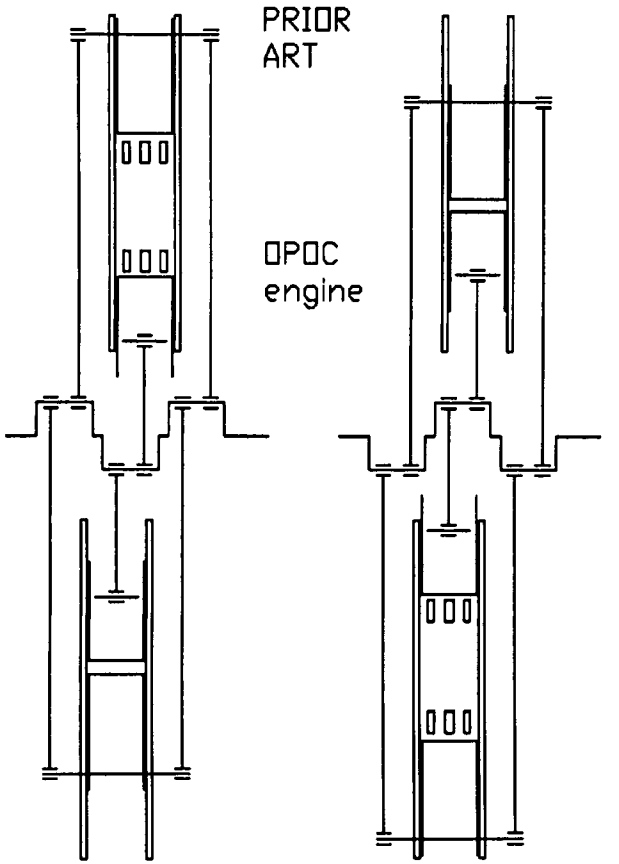
Fig 3a
Fig 3b
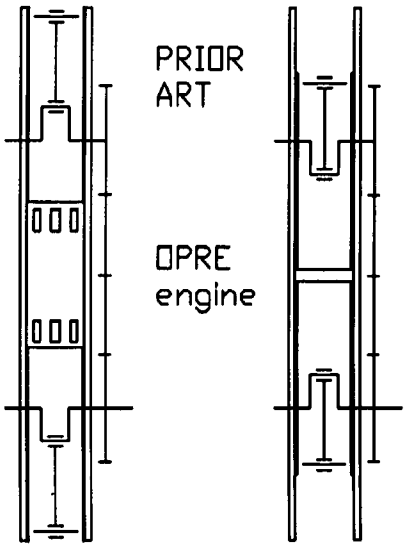
Fig 4a
Fig 4b
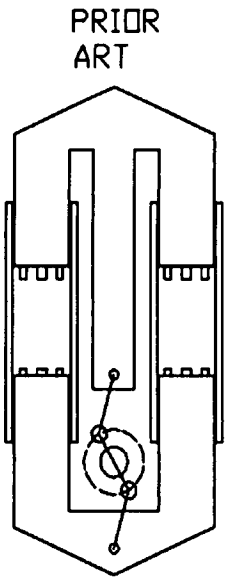
Fig 5

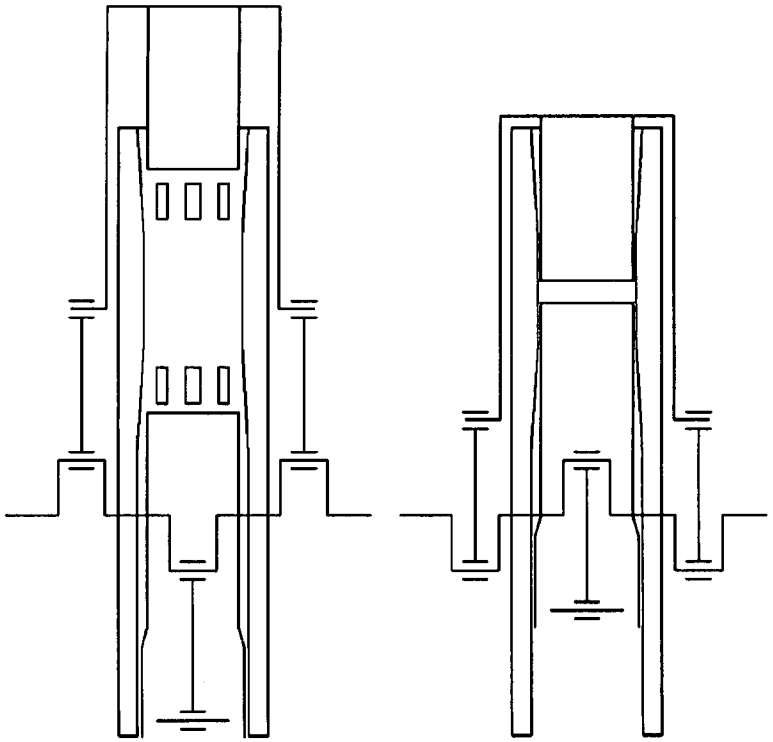
Fig 8a
Fig 8b
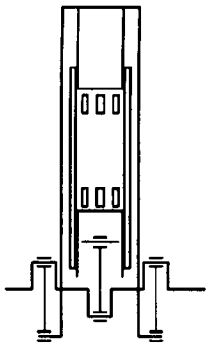
Fig 6a
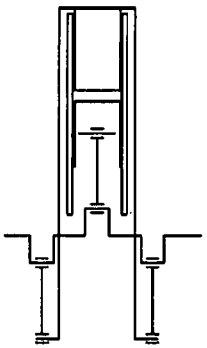
Fig 6b
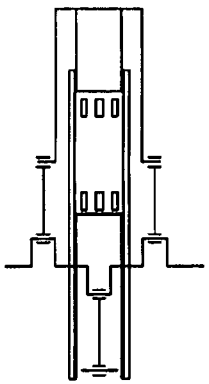
Fig 7a
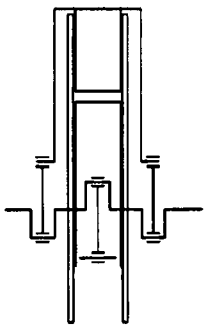
Fig 7b

RECIPROCATING PISTON ENGINE

BACKGROUND OF THE INVENTION

Closest prior art: the WO 2007/085649 A2 Opposed piston Pulling Rod Engine (OPRE), the U.S. Pat. No. 6,170,443 Opposed Piston Opposed Cylinder engine (OPOC) and the U.S. Pat. No. 1,679,976 Junkers-Doxford engine. Close prior art is also the U.S. Pat. No. 4,732,115 of Lapeyre and the U.S. Pat. No. 4,115,037 of Milton.

The two connecting rods of the OPRE engine are "pulling rods" or "pullrods" in the sense that the high pressure of the combustion chamber loads them exclusively in tension. On the same reasoning the connecting rods of a conventional engine are pushrods.

The pullrod arrangement increases by some 35% (depending on the connecting rod to stroke ratio) the time the piston remains at the last 15% of its stroke near the combustion dead center, i.e. where the injection, the preparation of the fuel mixture, the delay and the most significant and efficient part of the combustion complete. On the same reasoning, when a pullrod engine revs at 35% higher revs than the conventional, it provides to the fuel similar conditions with the conventional.

The U.S. Pat. No. 4,732,115 of Lapeyre necessitates pairs of cylinders and simultaneous combustion at pairs of combustion chambers.

The U.S. Pat. No. 4,115,037 of Milton involves a crankshaft located necessarily at one side of the cylinder.

BRIEF SUMMARY OF THE INVENTION

Some of the objects of this invention are:

to improve the balancing quality of the Junkers-Doxford engine;

to maintain the advantages of the OPRE engine, like the longer piston dwell around the combustion dead center, the crosshead architecture, the "four stroke like" lubrication, the built-in volumetric scavenging pump etc, while eliminating the second crankshaft, the synchronizing gearing and the loads on the main crankshaft journals;

to provide a full-balanced single-cylinder single-crankshaft two-piston module;

to provide a single cylinder module for multicylinders;

to provide a port-less through-scavenged two-stroke engine having true four-stroke lubrication.

BRIEF DESCRIPTION OF THE DRAWINGS

FIGS. 3*a* and 3*b* show the OPOC engine: two oppositely arranged Junkers-Doxford engines share the same crankshaft for the sake of a better dynamic balance with asymmetrical port timing.

FIGS. 4*a* and 4*b* show the OPRE engine comprising two synchronized crankshafts.

FIG. 5 shows the engine of Lapeyre.

FIGS. 6*a* and 6*b* show an embodiment of this invention wherein all the connecting rods are pushrods.

FIGS. 7*a* and 7*b* show another embodiment of this invention wherein all the connecting rods are pullrods.

FIGS. 8*a* and 8*b* show the arrangement of FIGS. 7*a* and 7*b* with a different cylinder: the cylinder bore increases, i.e. it is tapered, at the two ends of the cylinder. This way the piston rings can avoid touching the bore at a good part of the piston stroke, with the corresponding reduction of the friction and the wear. The piston skirt at the combustion side of the piston needs not touch the cylinder because the thrust loads are taken at the "wrist pin" side of the piston, away from the combustion chamber.

The piston and the piston rings are lubricated by the crankcase lubricant as in the conventional four-stroke engines, while the working medium is isolated from the crankcase lubricant as the working medium of the conventional four-stroke is isolated from the crankcase lubricant.

The connecting rods are disposed at the two sides of the cylinder, outside the cylinder footprint, to rid the space behind the piston of obstacles like a piston pin and a connecting rod, in order to free the flow of the working medium and to make space for the valve actuator and its mechanism.

The piston comprises valve seats and valve guides. The piston bears intake poppet valves and restoring springs. The exhaust valves are controlled conventionally, for instance by cams secured to the crankshaft. An intake camshaft rotates in synchronization with the crankshaft by means of sprockets, gears etc. A valve actuator, comprising valve lash adjusters, is displaced by the intake camshaft and is restored by restoring springs. During the compression, the combustion and the expansion, the intake valves move together with the piston. The right moment the exhaust valves open and the pressure inside the cylinder drops. At a crankshaft angle, the intake valves land on the valve actuator and start following its motion. Compressed air from the backside of the intake piston enters the cylinder, through the ports/holes on the piston crown, and scavenges the exhaust gas. The right moment the exhaust valves close. Compressed air continuous to enter the cylinder until the intake valves land on the valve seats on the piston crown and start following the piston motion. The compression begins.

Two of the main objectives of a right intake camlobe are: to allow the intake valves to pass smoothly, quietly and reliably from the motion with the piston to the motion with the valve actuator (and vice versa), and to protect the poppet valves of the piston, and their restoring springs, from excessive valve lifts.

Figure 28:
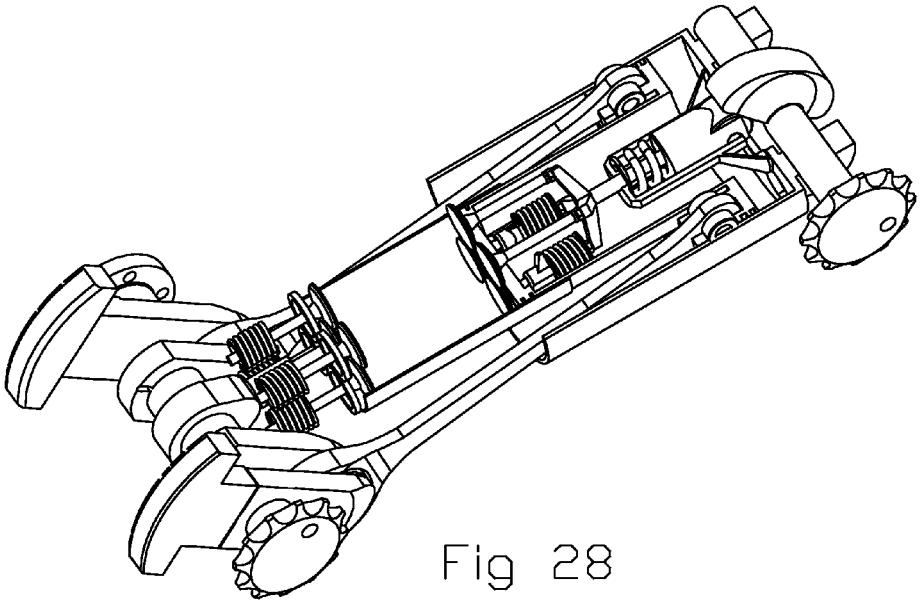
FIG. 28 shows a variation of the engine of FIG. 27. It is a port-less through-scavenging two-stroke engine. With the cylinder liner rid of intake and of exhaust ports, this engine combines a true "four-stroke" lubrication and lubricant consumption, with the uniflow scavenging efficiency and with double valve area.

By counterweights secured on the two intake camshafts, the even firing opposed cylinder version of this engine is full balanced. In FIG. 28 the crankshaft is at 135 degrees after the TDC; the exhaust valves are widely open; the intake valves have started opening.

Figure 29:
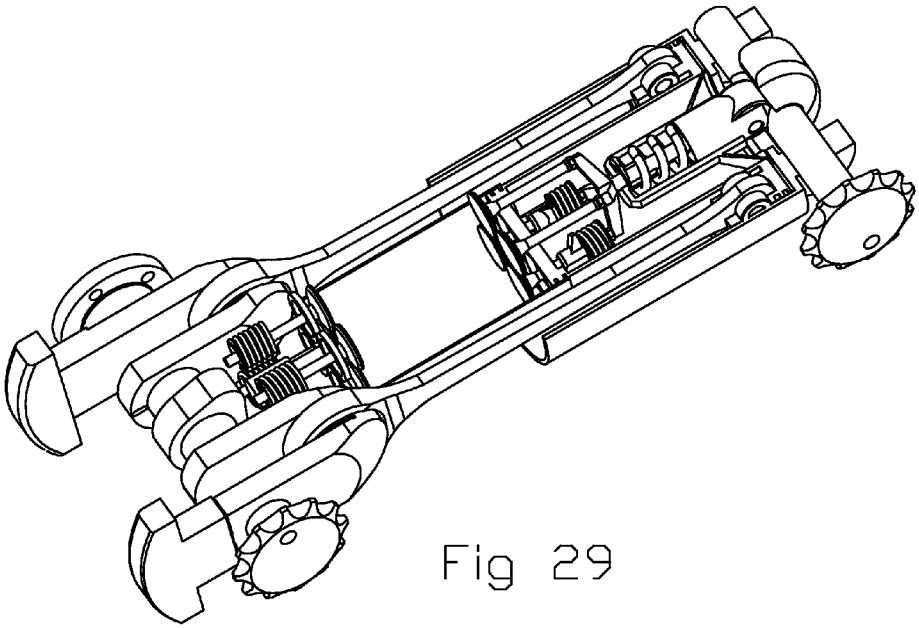

FIG. 29 shows the engine of FIG. 28 with the crankshaft at 180 degrees after the TDC. The intake valves are widely open, while the exhaust valves have started closing.

Figure 30:
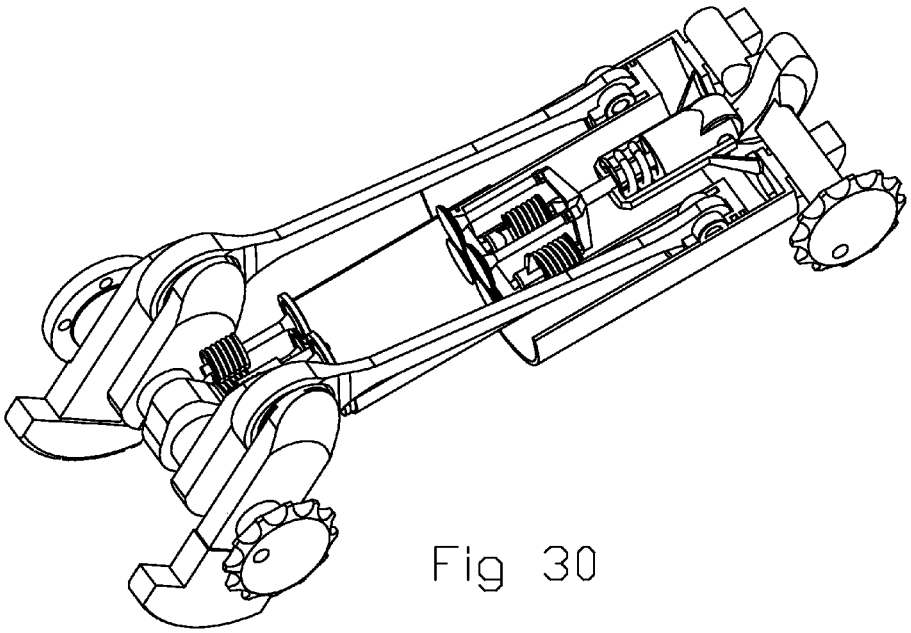

FIG. 30 shows the engine of FIG. 28 with the crankshaft at 225 degrees after the TDC. The intake valves are only slightly open, near to their valve seats on the piston crown. In a few degrees the piston will gently take them up from the valve actuator.

Figure 31:
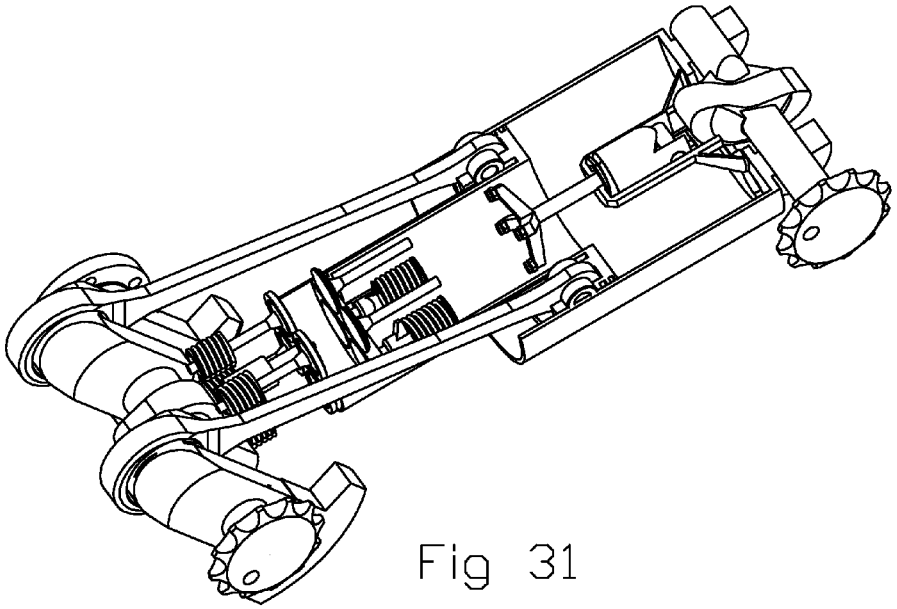

FIG. 31 shows the engine of FIG. 28 with the crankshaft at 300 degrees after the TDC. The restoring springs and the pressure inside the cylinder decelerate the intake valves, keeping them firmly onto their valve seats on the piston crown.

Figure 32:
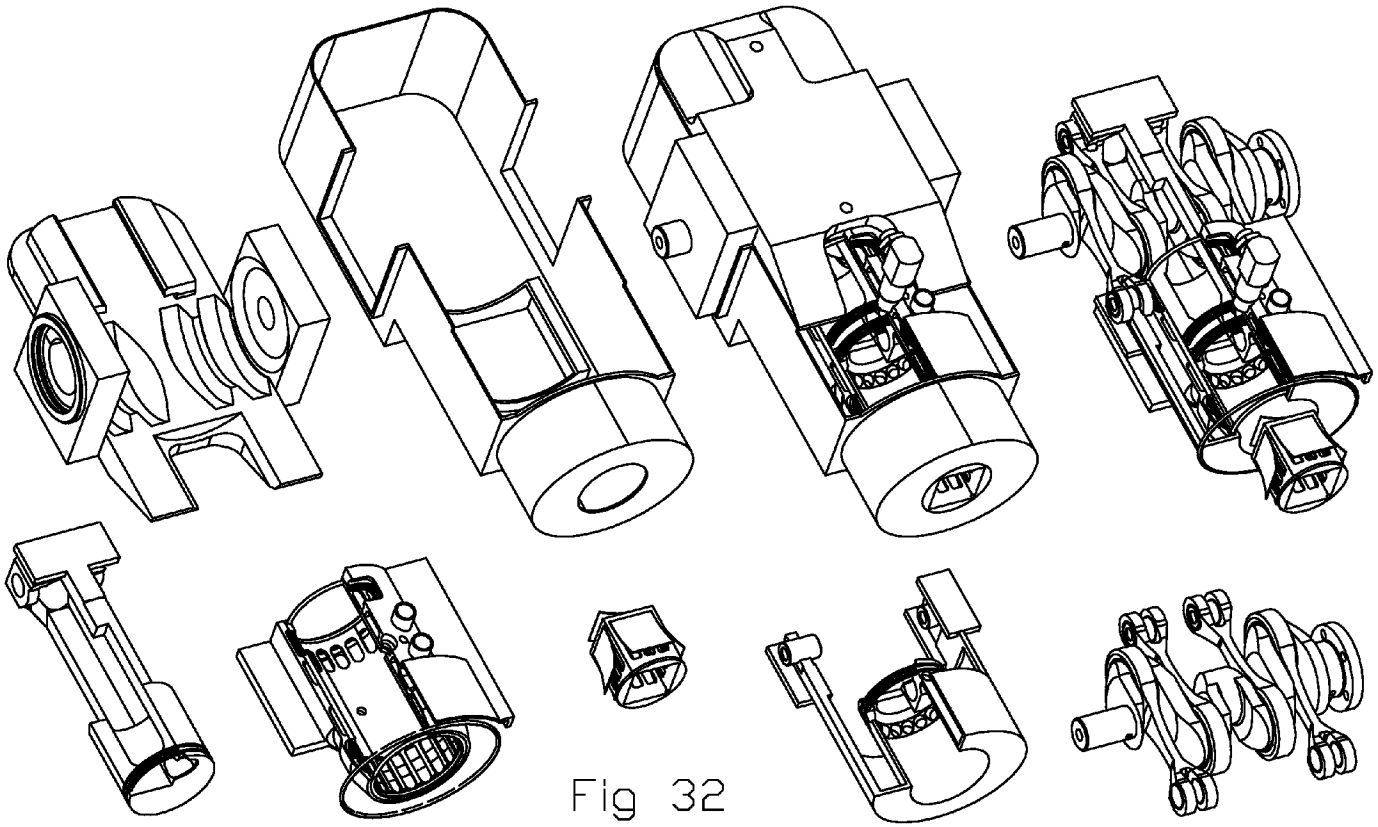

FIG. 32 shows an internal combustion engine having a basic module comprising: a single crankshaft having a plurality of crankpins; a single cylinder having a first piston and a second piston reciprocably disposed therein and forming a combustion chamber therebetween; a first connecting rod that drivingly couples the first piston to a corresponding crankpin on the crankshaft; a second connecting rod that drivingly couples the second piston to a corresponding crankpin on the crankshaft, said first and second connecting rods are both pullrods.

From bottom-left, FIG. 32: the exhaust piston with its slipper at the wrist pin end; the cylinder having, at both sides, sliders for the intake piston slippers, the cylinder liner with the exhaust ports and the long intake ports, the oval scavenge pump seal; the one way valve; the intake piston assembly comprising an intake piston with ports on its skirt, an oval scavenging piston and slippers at the wrist pin side; the crankshaft with the pullrods on it.

From top-left, FIG. 32: the basic-plate with the main crankshaft bearings and the sliders for the exhaust piston slipper; the oil pan comprising the scavenging pump cylinder; the complete engine; and the engine after the removal of the oil pan and of the plate with the main bearings.

The intake piston skirt has ports that cooperate with the cylinder liner intake ports/niches, eliminating the transfer pipes of the engine of FIG. 24. An one-way valve traps the air into the scavenge cylinder until the ports of the skirt of the intake piston align with the intake ports of the cylinder liner and the scavenging of the cylinder, by the compressed air, begins. The scavenge piston is ring-less; it has an elliptical/oval shape to compensate with the distance of the "intake crankpins" without overly increasing the scavenge piston area. Immovable rings (seals) are in touch with the scavenge piston, keeping the lubricant at the crankcase side and the compressed air at the scavenging pump side, enabling a variety of scavenge cylinder shapes. The slippers bear the thrust loads.

Figure 33:
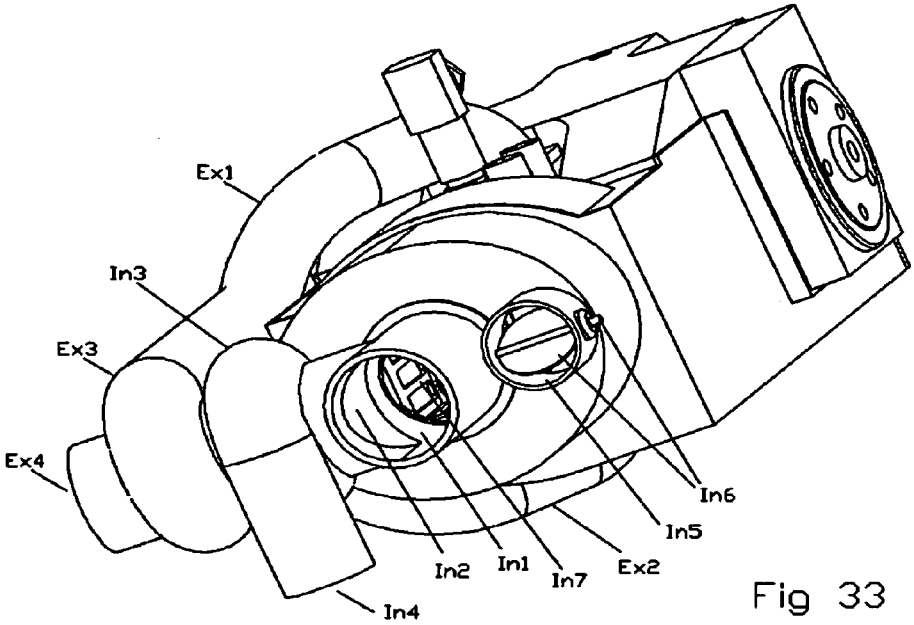

FIG. 33 shows the engine of FIG. 32 in case of turbo-supercharging. The two exhaust pipes Ex1 and Ex2 feed the Ex3 turbine. The exhaust gas leaves through the turbine exhaust gas outlet Ex4. Air (or air and re-circulating exhaust gas) from the pipe In1 enters, through the pipe In2, into the turbocharger-compressor In3. The compressed air leaves the turbocharger-compressor through the pipe In4 to the cooler (not shown). From the cooler the compressed air returns to the pipe In5. A throttle valve In6 allows or stops the flow from the cooler to the space behind the intake piston (scavenging pump). When the delivered by the turbocharger pressure is low (like at cranking, at low revs, at light loads etc) the throttle valve In6 is kept closed, air enters through the one way valve In7 into the scavenge cylinder and is trapped there for the scavenging. When the turbocharger provides enough pressure, the throttle valve opens, the one way valve remains constantly closed (less noise, improved reliability) and the scavenging is made by exploiting the energy of the exhaust gas.

Figures 24A, 24B, 24C, 24D, 24E, 24F, 24G:
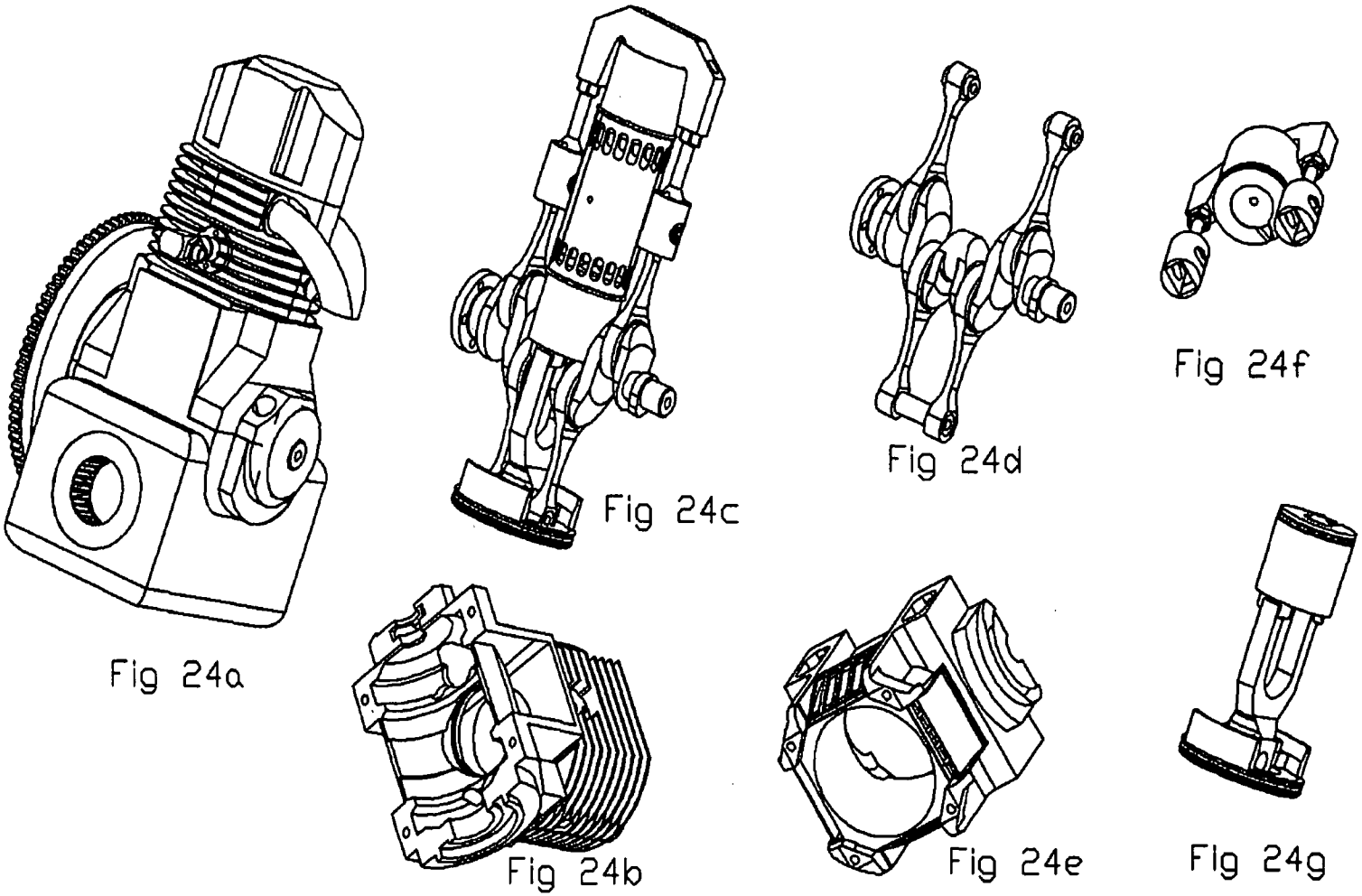
FIGS. 24*a*, 24*b*, 24*c*, 24*d*, 24*e*, 24*f* and 24*g* show the first prototype made and tested. Two connecting rods for the intake piston and two connecting rods for the exhaust piston are used. All connecting rods are pullrods. The big diameter piston of the scavenging pump is secured, by two "pillars", to the intake piston and moves below the crankshaft. One-way valves trap the air into the big diameter cylinder and into the transfer "pipes" waiting the intake ports to open.
Figure 25:
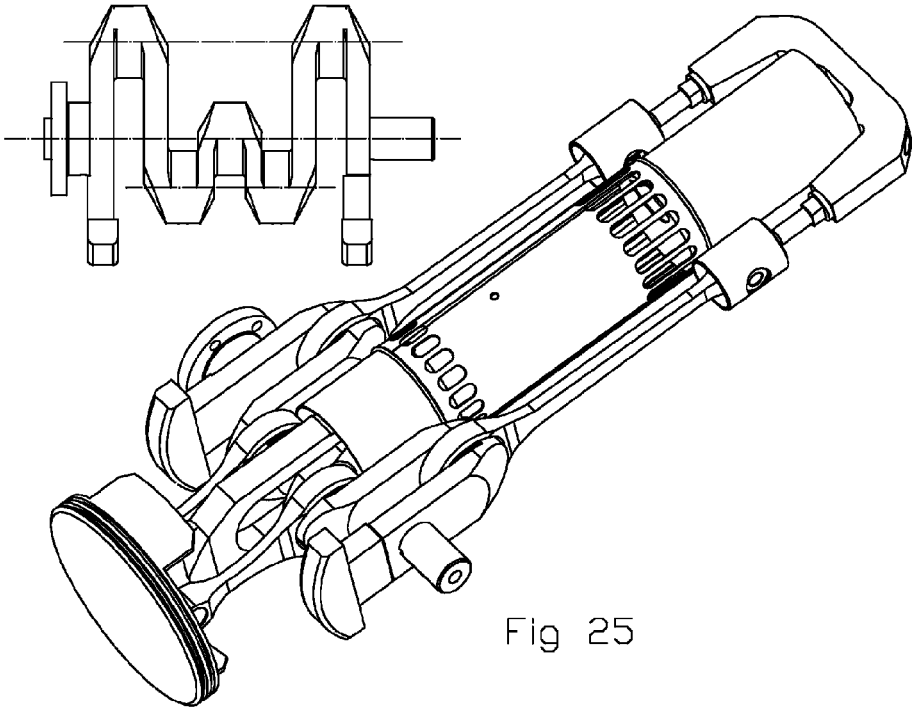
FIG. 25 shows another embodiment wherein the stroke of the intake piston is shorter than the stroke of the exhaust piston. Selecting properly the lengths of the connecting rods and the mass of the moving parts, the engine can be fully balanced. An advantage is a sorter engine for a given total piston stroke.
Figure 26:
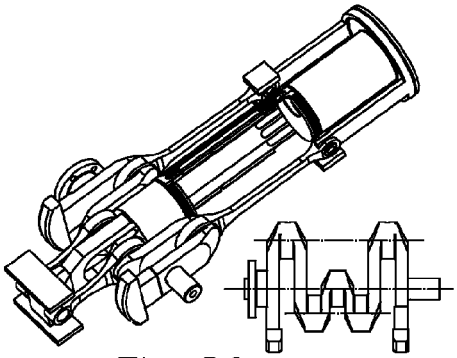
FIG. 26 shows a variation of the engine of FIG. 25. Here the intake piston and the scavenge piston, have the longer stroke.
Figure 27:
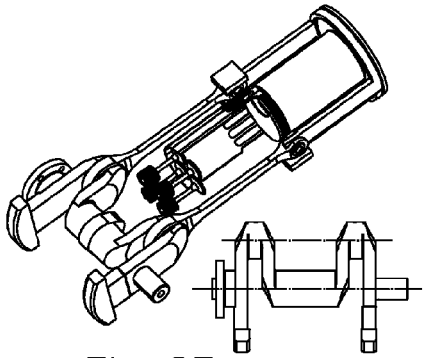
FIG. 27 shows a variation of the engine of FIG. 26 wherein the stroke of the exhaust piston becomes zero. The exhaust piston becomes immovable and functions as a cylinder head. The exhaust gas leaves the combustion chamber through conventional exhaust poppet valves on the cylinder head. The intake piston skirt still controls conventionally the intake ports on the cylinder liner. It makes clear that the transition from the single piston engines to the opposed piston engines and vice-versa is a pure mathematical deduction involving only the reduction of a crank-throw to the limit, i.e. to zero.
Figure 34A:
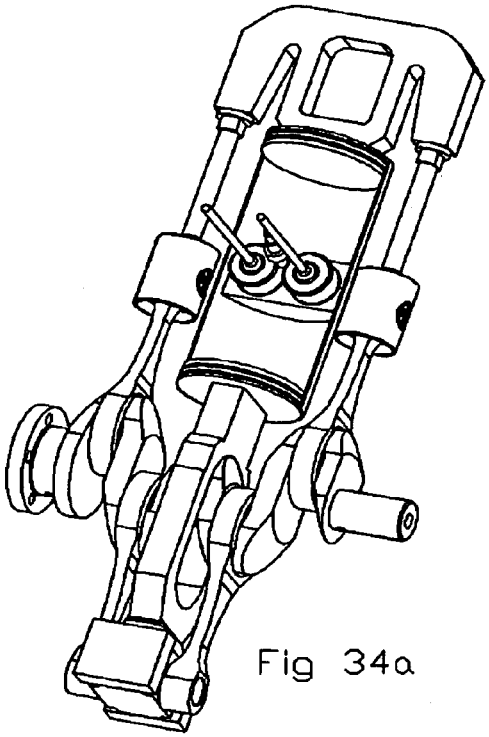
Figure 34B:
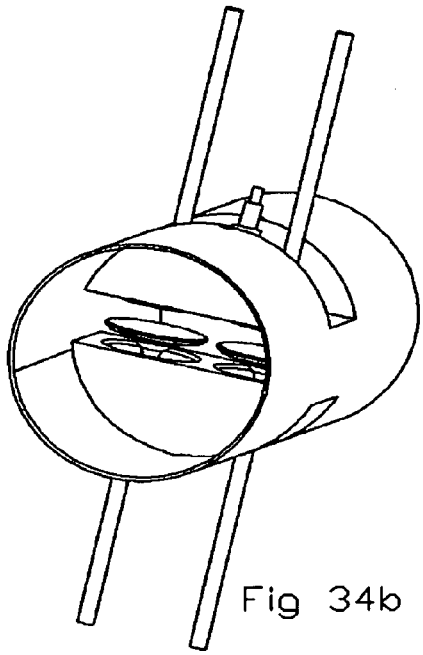

FIGS. 34*a* and 34*b* show a variation of the engine of FIG. 24*a*. This engine is a four-stroke full-balanced single-cylinder, with intake and exhaust poppet valves at the middle of the cylinder, as FIG. 34*b* shows.

PREFERRED EMBODIMENTS

In a first preferred embodiment, FIGS. 9*a* to 14, the crankshaft (1) drives, by means of the pullrods (2) and (3), the two opposed pistons (4) and (5) respectively.

The pullrod arrangement generates a longer piston dwell around the combustion, as compared to the conventional engine, and a shorter piston dwell during the scavenging.

The pistons (4) and (5) are reciprocably disposed into the same cylinder (6) and seal two sides of the same combustion chamber (7) therein.

The cylinder (6) comprises intake ports (8) and exhaust ports (9) that the reciprocating pistons cover and uncover.

The connecting rod of the upper piston and the connecting rod of the lower piston are, in case of symmetrical timing, always parallel. With equal diameters of the two opposed pistons, the forces applied to the crankshaft are parallel and equal, i.e. the total force on the main crankshaft bearings is zero. The same is true for the inertia forces: in case of equal mass of the two reciprocating assemblies, the total inertia force on the main bearings of the crankshaft is always zero. In case of symmetrical timing, the engine balance can be perfect as regards the inertia forces and the inertia moments.

In case of asymmetrical timing, the pullrod-arrangement enables a smaller offset of the crankpins, thereby lesser spoiling of the dynamic balancing.

In a second preferred embodiment, FIGS. 15 to 21, the opposite to the combustion chamber side of the lower piston forms a scavenging pump. The diameter of the scavenging piston defines the scavenging ratio. Through proper ducts the fresh air flows to the intake ports awaiting the piston to uncover them.

In a third preferred embodiment, FIGS. 8*a* and 8*b*, the bore of the combustion cylinder increases towards the ports to reduce the friction and the wear of the piston rings and port bridges.

In a fourth preferred embodiment, FIGS. 6*a*, 6*b*, 23*a*, 23*b*, 23*c*, 23*d*, 23*e* and 23*f*, both pistons are drivingly coupled to the same unique crankshaft by pushrods. In case of symmetrical timing, the balance of the inertia forces can be perfect.

The crosshead architecture eliminates the thrust loads from the pistons to the cylinder liner. Theoretically, the pistons never touch the cylinder liner. On this reasoning, only the piston rings need lubrication.

In the four stroke engines a lubricant film of about 0.002 mm (actually a dye of oil on the cylinder liner surface) is what actually protects the top compression ring from the dry contact with the liner.

The additional time provided by the pullrod arrangement for the injection and the combustion of the fuel, helps the biofuels and the neat vegetable oils with their longer ignition delays.

Figures 1A, 1B:
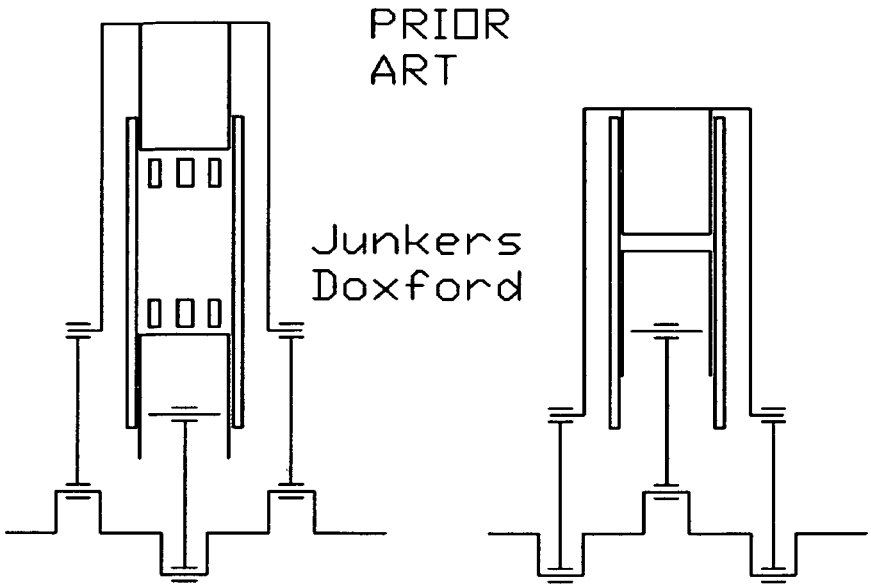
FIGS. 1*a* and 1*b* show the engine of Junkers-Doxford. The central connecting rod is a pushrod, the side connecting rods are pullrods.
Figures 2A, 2B:
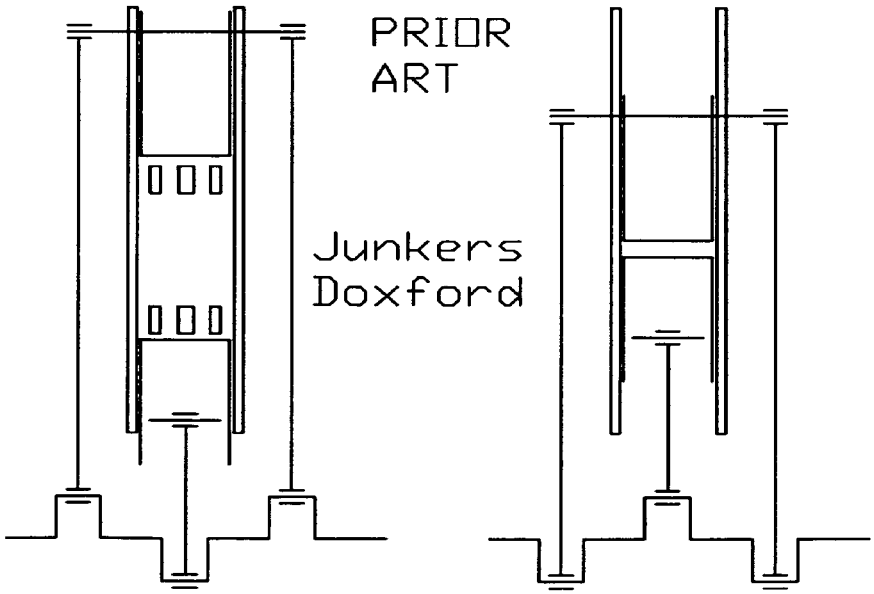
FIGS. 2*a* and 2*b* show another version of the Junkers-Doxford engine wherein the side connecting rods extend to hold the piston pin.
Figure 10B:
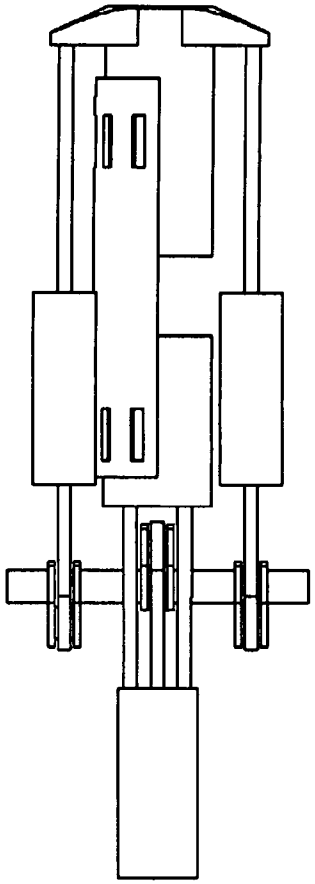
FIGS. 10*a* and 10*b* show the engine of FIGS. 9*a* and 9*b* with the crankshaft rotated for 60 degrees.
Figure 10A:
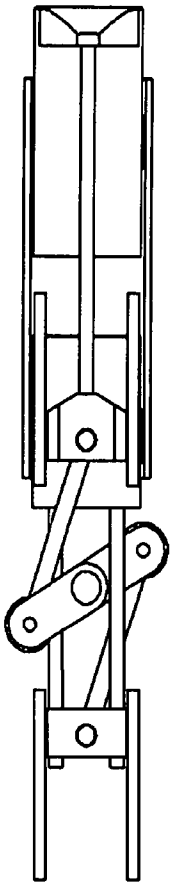
Figure 9B:
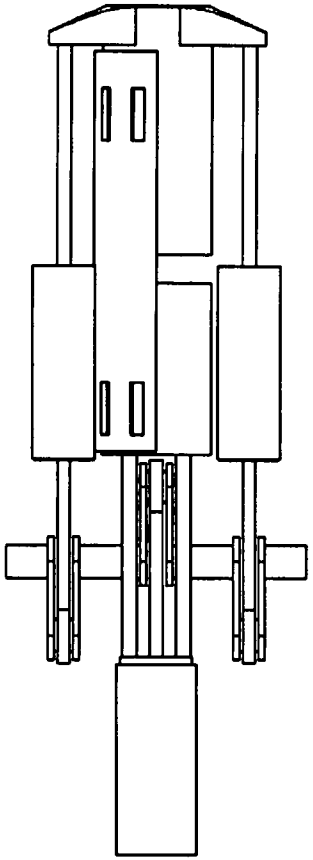
FIGS. 9*a* and 9*b* show an embodiment of this invention from two viewpoints. In this embodiment all connecting rods are pullrods. The cylinder is sliced to show more details. The pistons are at the combustion dead center.
Figure 9A:
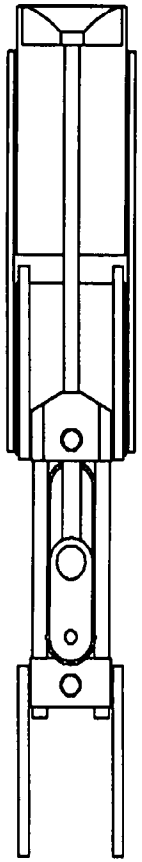
Figure 12B:
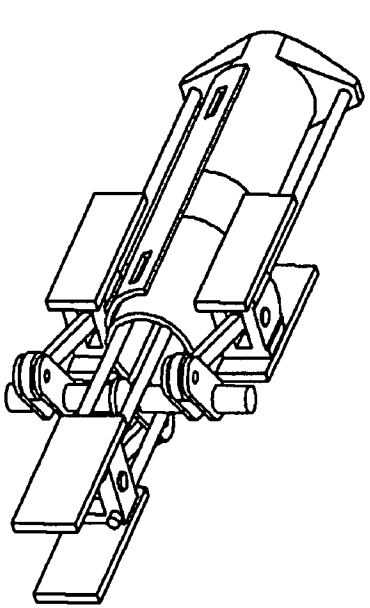
FIGS. 12*a* and 12*b* show the engine of FIGS. 10*a* and 10*b* from another viewpoint.
Figure 12A:
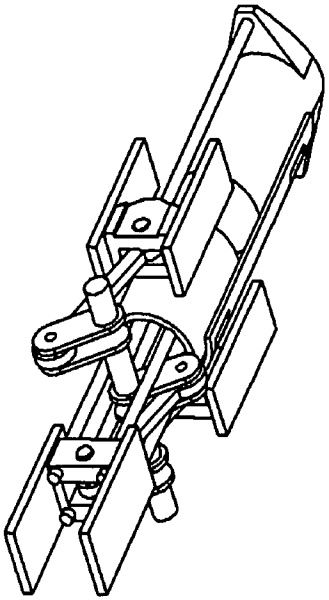
Figure 11B:
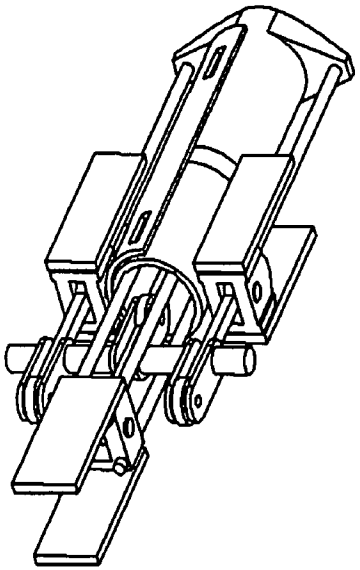
FIGS. 11*a* and 11*b* show the engine of FIGS. 9*a* and 9*b* from another viewpoint.
Figure 11A:
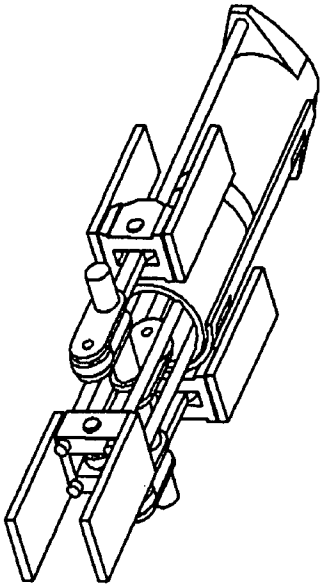
Figure 14:
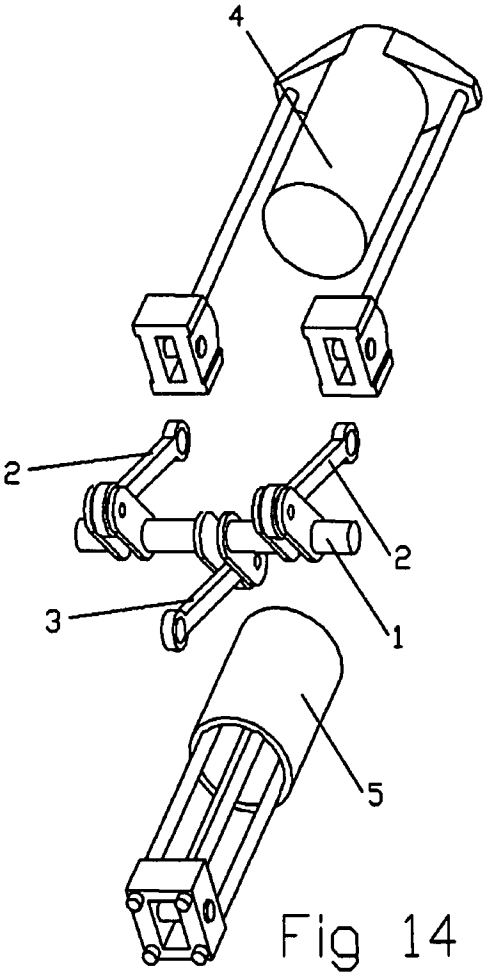
FIG. 14 shows the assembly of FIGS. 13*a* and 13*b* exploded.
Figure 13B:
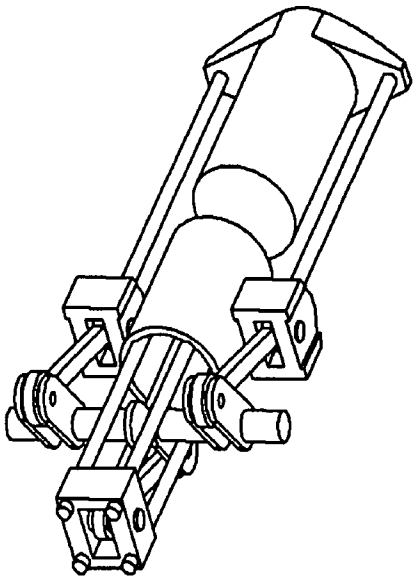
FIGS. 13*a* and 13*b* show the assembly of the pistons, the connecting rods and the crankshaft of the engine of FIGS. 12*a* and 12*b*.
Figure 13A:
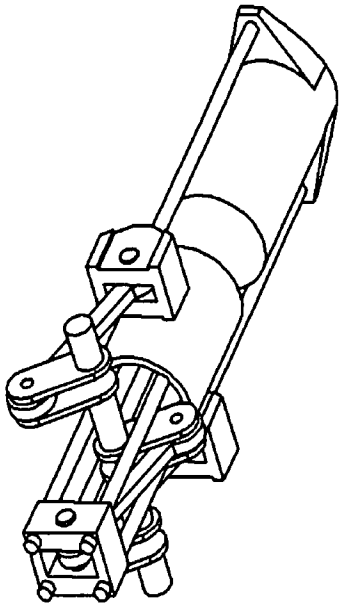
Figure 16:
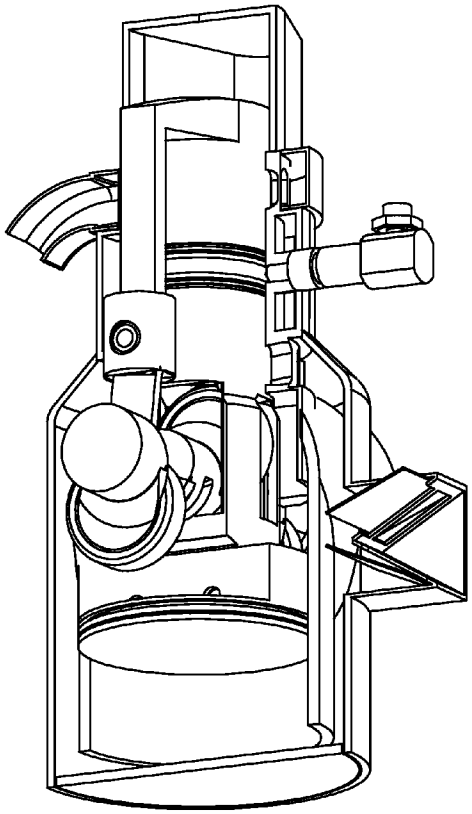
FIG. 16 shows the engine of FIG. 15 from another viewpoint.
Figure 15:
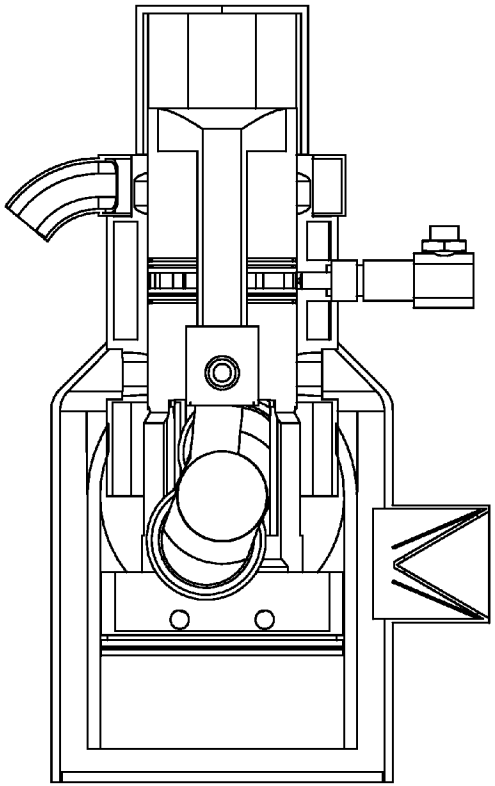
FIG. 15 shows another embodiment of this invention. The covers and the cylinder are sliced. A big diameter "scavenging" piston is secured at the bottom of the lower piston and is slidably fitted into a big diameter cylinder that takes the thrust loads. The upward motion of the scavenging piston creates a vacuum that draws the air through the reed valve, shown at right. The downward motion of the scavenging piston displaces the air, the reed valve traps the air and when the piston uncovers the intake ports the pressurized air enters the combustion cylinder and scavenges the exhaust gas. An injector, shown at middle right, delivers the fuel.
Figure 18:
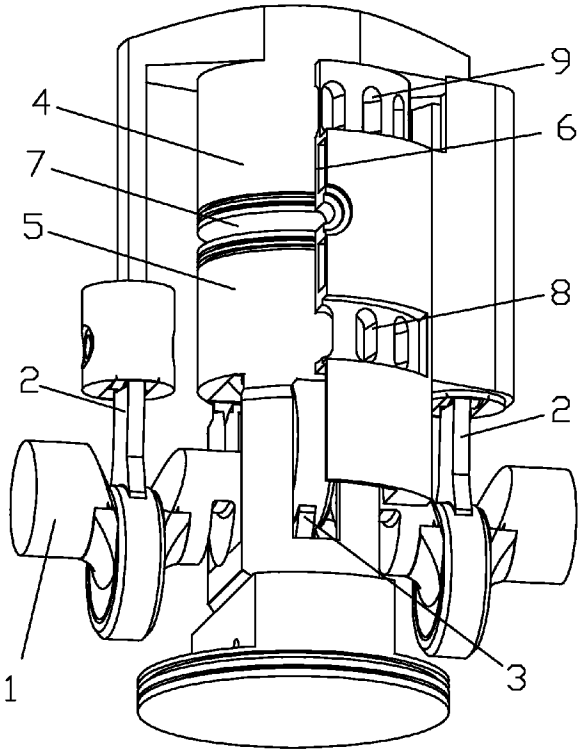
FIG. 18 shows, from another viewpoint, the assembly of FIG. 17.
Figure 17:
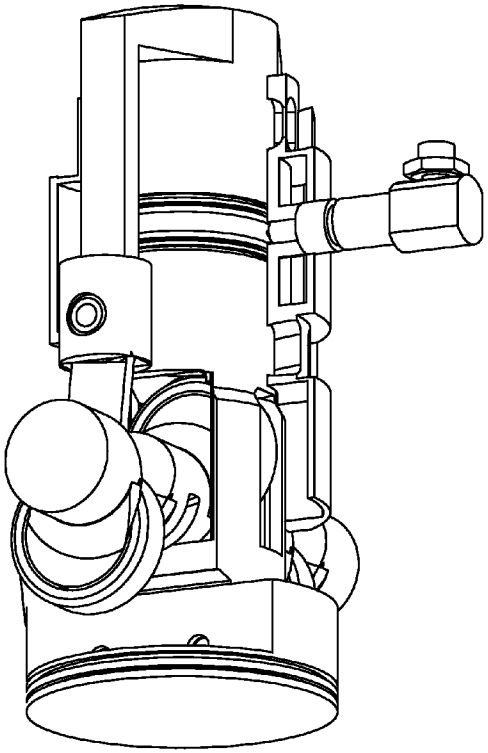
FIG. 17 shows the engine of FIG. 16 after the removal of some parts and covers.
Figure 20:
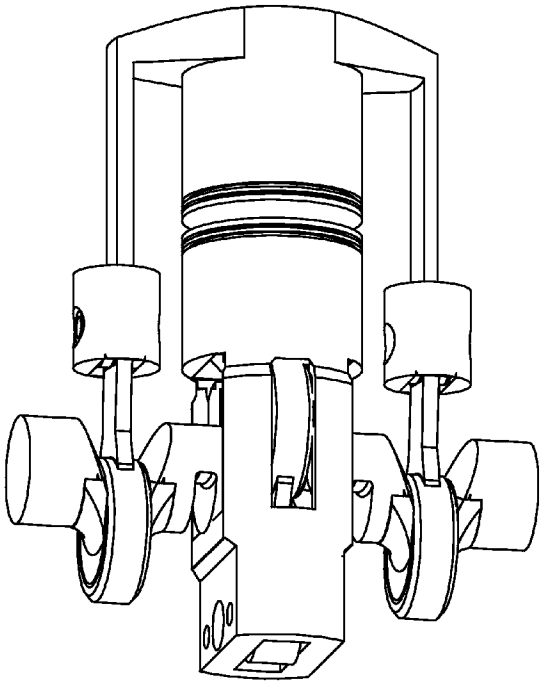
FIG. 20 shows only the pistons, the crankshaft and the connecting rods of the engine of FIG. 15. The upper piston comprises a piston crown and piston rings that seal the upper side of the combustion chamber, a piston skirt that covers and uncovers the exhaust ports, a bridge that transfers the forces from the piston crown to the two side arms, the two side arms with the cylindrical sliders at their lower ends. The lower piston comprises a piston crown and piston rings that seal the lower side of the combustion chamber, a piston skirt that covers and uncovers the intake ports, four pillars surrounding the crankshaft, that transfer the force from the piston crown to the lower end, where the wrist pin is. Both pistons are drivingly coupled to the crankshaft by pullrods.
Figure 19:
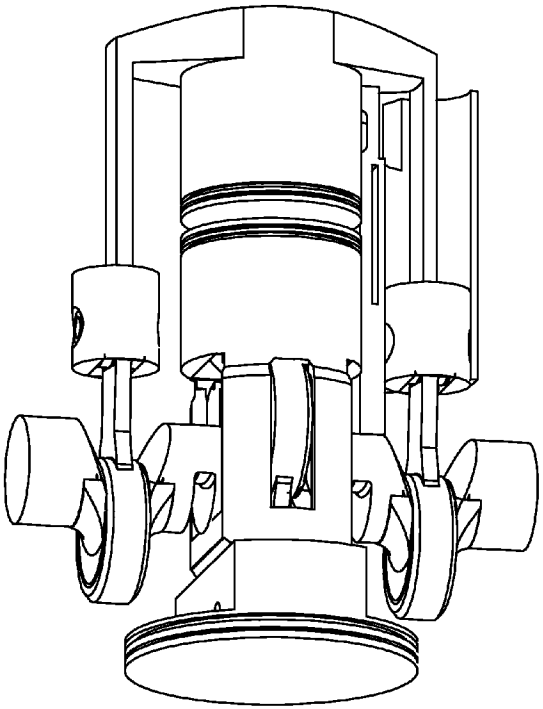
FIG. 19 shows the assembly of FIG. 18 after the removal of a part of the cylinder.
Figure 22:
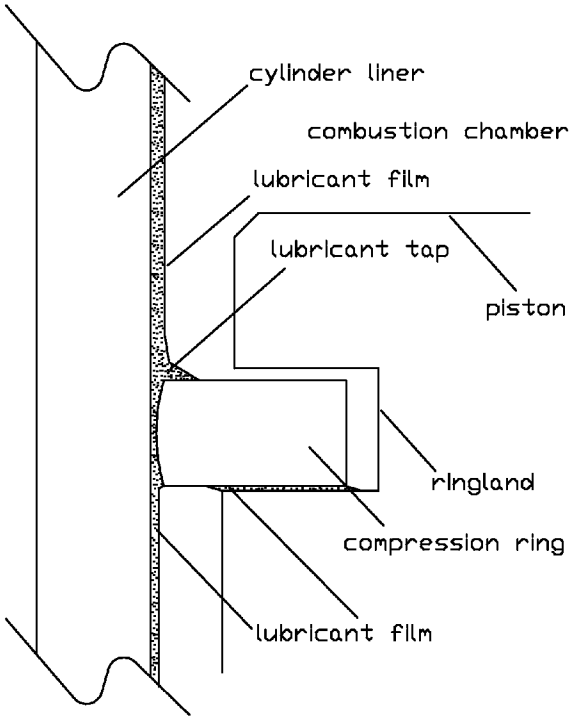
FIG. 22 explains a way for the lubrication of the rings from within the combustion chamber.
Figure 21:
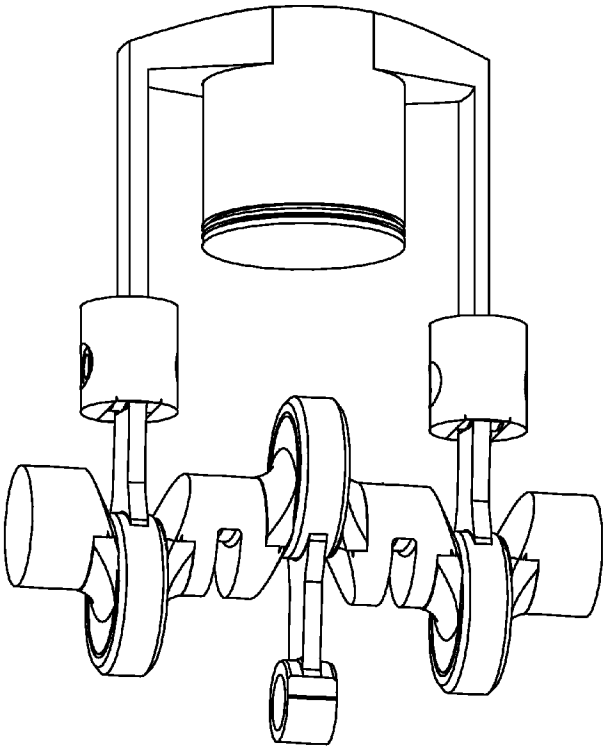
FIG. 21 shows the assembly shown in FIG. 20 after the removal of the lower piston.
Figures 23A, 23B, 23C, 23D, 23E, 23F:
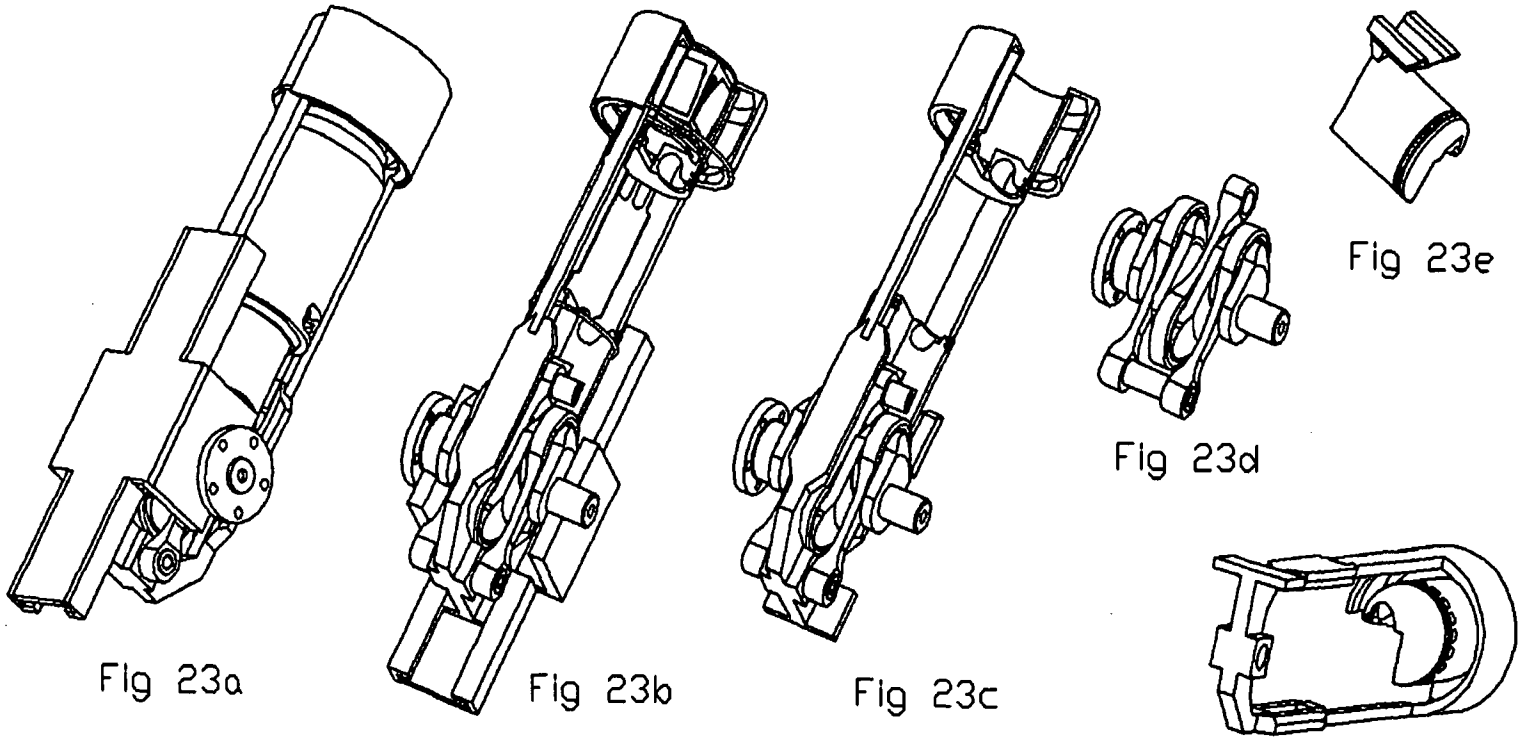
FIGS. 23*a*, 23*b*, 23*c*, 23*d*, 23*e* and 23*f*, like FIGS. 6*a* and 6*b*, show a basic module wherein both opposed pistons are drivingly coupled to the unique crankshaft by pushrods. The big diameter piston at the backside of the intake piston is the scavenge piston. Ports on the skirt of the intake piston cooperate with the intake ports of the cylinder liner for the scavenging. The connecting rods can be arranged inside the cylinder footprint, enabling for more compact multicylinders.

The better lubricity of the biofuel and the vegetable oil, relative to the Diesel, enables the lubrication of the compression rings from "inside" as shown in FIG. 22. A small part of the injected vegetable oil inevitably, or intentionally, wets the cylinder liner. The compression rings sweep this spilled over quantity of fuel, building up a liquid seal all around the ring. A dynamic oil-sealing is achieved as the pistons reach the combustion dead center, with a cooling, lubricating and sealing effect.

A variation of the opposed piston arrangements is the case wherein the cylinder comprises two halves.

The two halves may have different bores.

The two halves may be arranged at some wide angle to provide asymmetrical timing etc.

The crankshaft may have some slight offset from the cylinder axis, as in the conventional engines. This also generates an asymmetrical timing.

Although the invention has been described and illustrated in detail, the spirit and scope of the present invention are to be limited only by the terms of the appended claims.

The invention claimed is:

1. An opposed piston internal combustion engine having a basic module comprising:

a combustion chamber defined within a cylinder, a pair of opposed pistons slidably fitted in said cylinder and sealing two sides of the combustion chamber, said pair of opposed pistons comprising a first piston and a second piston, a crankshaft having a plurality of crankpins, said first piston is comprising at a first end a piston crown contained in the cylinder, said first piston is comprising at a second end a first wrist pin, said first piston is comprising arms interconnecting said piston crown and said first wrist pin, wherein said arms, at the first end side of the piston, are extending laterally, with respect to the cylinder, outward, then longitudinally in-line with the cylinder to the side opposite the cylinder from the piston crown, and then inward laterally towards the wrist pin to form an opening which surrounds the cylinder and crankshaft, a first connecting rod drivingly coupling said first piston to a first crankpin of said crankshaft, said first connecting rod being pivotally mounted at an end to said first wrist pin, a second connecting rod drivingly coupling said second piston to a second crankpin of said crankshaft, said second connecting rod being pivotally mounted at an end to a second wrist pin, said second wrist pin moving in unison with said second piston, and a high pressure in the combustion chamber is loading with compressive loads said first connecting rod and said second connecting rod.

2. An opposed piston internal combustion engine according claim 1, wherein along the direction of a rotation axis of the crankshaft the first piston is disposed inside a footprint of the cylinder.

3. An opposed piston internal combustion engine according claim 1, wherein said first wrist pin and said second wrist pin being disposed, at least partly, inside the footprint of an external surface of the cylinder so that the dimension of the basic module along a rotation axis of the crankshaft is reduced.

4. An opposed piston internal combustion engine according claim 1, wherein on said first piston it is secured the piston of a scavenging pump or compressor or pump.

5. A through-scavenging two-stroke engine comprising at least:

a crankcase, a cylinder forming a combustion chamber therein, the cylinder is mounted on the crankcase, a cylinder head sealing one side of the combustion chamber, the cylinder head is comprising an exhaust port and an exhaust poppet valve controlling the exhaust port, a crankshaft rotatably mounted into the crankcase, a piston slidably fitted in said cylinder, the piston is comprising a piston crown and a piston skirt, the piston crown is separating the combustion chamber from a space underside the piston crown, the piston crown is comprising an intake port and an intake poppet valve having a restoring valve spring, wherein the intake poppet valve is controlling the communication of the combustion chamber, through the intake port, with the space underside the piston crown, a pair of connecting rods disposed at the two sides of the cylinder, outside the cylinder footprint, are coupling the piston with the crankshaft, and an oil scraper ring is sealing the space underside the piston crown from the crankcase.

6. A through-scavenging two-stroke engine, according claim 5, wherein the piston is having a set of piston rings slidably fitted to the cylinder, the set of piston rings is sealing the combustion chamber from the crankcase, the surface of the cylinder wherein the set of piston rings slide is rid of ports.

7. A through-scavenging two-stroke engine, according claim 5, wherein the combustion chamber is disposed between the crankshaft and the piston crown so that the pressure into the combustion chamber is loading the connecting rods in tension.

8. A through-scavenging two-stroke engine, according claim 5, wherein the crankshaft is arranged inside the cylinder head, the combustion chamber is disposed between the crankshaft and the piston crown, so that additional time is provided for the combustion of the fuel.

9. A through-scavenging two-stroke engine, according claim 5, wherein:

the combustion chamber is disposed between the crankshaft and the piston crown so that the pressure into the combustion chamber is loading the connecting rods in tension, so that the connecting rods are pulling rods, a secondary cylinder is disposed around the space underside the piston crown, the secondary cylinder is having a bore bigger than the bore of the cylinder, the secondary cylinder is receiving most of the thrust loads resulting from the inclination of the connecting rods relative to the axis of the cylinder.

10. A through-scavenging two-stroke engine, according claim 5, wherein:

a cam is rotating in synchronization to the crankshaft, a valve actuator is displaced by the cam and is restored by a restoring spring, at a crankshaft angle the intake poppet valve lands on the valve actuator opening the intake port and starting the scavenging of the combustion chamber, at another crankshaft angle the intake valve lands on the piston crown closing the intake port and finishing the scavenging of the combustion chamber.

11. A through-scavenging two-stroke engine, according claim 5, wherein:

a cam is rotating in synchronization to the crankshaft;

a valve actuator is disposed in the space underside the piston crown, the valve actuator is displaced under the camming action of the cam, at a crankshaft angle the intake poppet valve, under the control of the valve actuator, opens allowing the communication of the combustion chamber with the space underside the piston crown, at another crankshaft angle the intake poppet valve lands onto the piston crown closing the intake port and stopping the communication of the combustion chamber with the space underside the piston crown, the cam is such that the moments the intake poppet valve lands onto the valve actuator or onto the piston crown the speed of the valve actuator differs less than 10% from the speed of the piston.

* * * * *